US008926450B2

(12) United States Patent
Takahashi et al.

(10) Patent No.: US 8,926,450 B2
(45) Date of Patent: Jan. 6, 2015

(54) GOLF CLUB HEAD

(71) Applicant: Bridgestone Sports Co., Ltd., Minato-ku, Tokyo (JP)

(72) Inventors: Hiroshi Takahashi, Tokyo (JP); Yasunori Imamoto, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 13/904,779

(22) Filed: May 29, 2013

(65) Prior Publication Data

US 2013/0331203 A1 Dec. 12, 2013

(30) Foreign Application Priority Data

Jun. 11, 2012 (JP) ..... 2012-132157
Jun. 12, 2012 (JP) ..... 2012-132945
Jun. 22, 2012 (JP) ..... 2012-141168

(51) Int. Cl.
*A63B 53/08* (2006.01)
*A63B 53/04* (2006.01)
*A63B 49/06* (2006.01)

(52) U.S. Cl.
CPC ..... *A63B 53/0466* (2013.01); *A63B 2209/023* (2013.01); *A63B 2053/042* (2013.01); *A63B 2053/0416* (2013.01); *A63B 49/06* (2013.01); *A63B 2209/02* (2013.01); *A63B 2209/10* (2013.01); *A63B 2053/0433* (2013.01); *A63B 2053/0408* (2013.01); *A63B 2053/0491* (2013.01); *A63B 2053/0437* (2013.01)
USPC ..... 473/347; 473/348; 473/349; 473/345; 473/342

(58) Field of Classification Search
CPC ..... A63B 2209/02; A63B 2209/023; A63B 53/0466; A63B 53/08; A63B 2053/042
USPC ..... 473/347, 345, 348, 349, 342, 344
See application file for complete search history.

(56) References Cited

U.S. PATENT DOCUMENTS

| | | | | |
|---|---|---|---|---|
| 6,645,086 | B1 * | 11/2003 | Chen | 473/335 |
| 7,717,806 | B2 | 5/2010 | Kubota | |
| 7,798,919 | B2 | 9/2010 | Kubota | |
| 8,535,173 | B2 * | 9/2013 | Golden et al. | 473/307 |
| 2006/0084525 | A1 * | 4/2006 | Imamoto et al. | 473/345 |
| 2010/0048316 | A1 * | 2/2010 | Honea et al. | 473/282 |

FOREIGN PATENT DOCUMENTS

| | | |
|---|---|---|
| JP | 2003-339920 A | 12/2003 |
| JP | 2006-130065 A | 5/2006 |

* cited by examiner

*Primary Examiner* — Benjamin Layno
(74) *Attorney, Agent, or Firm* — Sughrue Mion, PLLC

(57) ABSTRACT

A hollow golf club head includes a face portion, a sole portion, a side portion, a crown portion, and a hozel portion. A main portion of the crown portion is made of a fiber reinforced resin. The fiber reinforced resin portion includes a bulk molding compound (BMC) molded body. At least the face portion, a leading edge of the crown portion continuous with the face portion, and a center portion of the sole portion in a toe-heel direction are made of a metal. Alternatively to this configuration, the face portion may be provided with a metal faceplate, a portion subsequent to the face portion may include a BMC molded body, and a rear portion of the crown portion may include a molded laminate of prepreg sheets. The height of center of gravity may be 24 mm or less.

9 Claims, 11 Drawing Sheets

GOLF CLUB HEAD

CROSS-REFERENCE TO RELATED APPLICATION

This application claims priorities from Japanese Patent Application No. 2012-132157 filed Jun. 11, 2012, Japanese Patent Application No. 2012-132945 filed Jun. 12, 2012, and Japanese Patent Application No. 2012-141168 filed Jun. 22, 2012, which are incorporated herein by reference in their entirety.

BACKGROUND OF THE INVENTION

The present invention relates to a hollow golf club head, and more particularly to a golf club head including a combination of metal portions and fiber reinforced resin portions.

As wood type golf club heads such as driver or fairway wood type golf club heads, hollow metal golf club heads have been widely used. A hollow wood type golf club head generally includes a face portion for hitting a ball, a crown portion which constitutes an upper surface portion of the golf club head, a sole portion which constitutes a bottom surface portion of the golf club head, a side portion including toe-side, back-side, and heel-side side surface portions of the golf club head, and a hozel portion. A shaft is inserted to the hozel portion and is fixed there with an adhesive or the like. Note that very many golf clubs such as utility clubs have been recently marketed. As some types of such utility golf clubs, various types of golf clubs with a hollow head similar to the above-described wood type golf club head (i.e., a head including a face portion, a sole portion, a side portion, and a crown portion, and a hozel portion) have been marketed.

As metals constituting such hollow golf club heads, aluminum alloys, stainless steel, and titanium alloys have been used. In recent years, titanium alloys have been widely used in particular.

The sweet spot of a hollow golf club head can be expanded by increasing the volume of the head. When the volume of a golf club head is increased, its weight may also be increased. In order to prevent this, it has been proposed to employ fiber reinforced resins having specific gravities smaller than those of the above-described metals as constituent materials of golf club heads. Because it is necessary in this configuration that the surface of a face for hitting a ball be made of a metal to secure a sufficient strength, it is required that portions other than the face portion be made of fiber reinforced resins.

Japanese Patent Application Publication No. 2003-339920 discloses a golf club head including a metal face portion, and the other portions thereof are made of carbon fiber reinforced thermosetting resins.

Japanese Patent Application Publication No. 2006-130065 discloses that a hollow golf club head includes a face portion, a sole portion, a side portion, a crown portion, and a hozel portion, a main portion of the crown portion being made of a fiber reinforced resin; at least the face portion, a leading edge of the crown portion continuous with the face portion, and at least a center portion of the sole portion in a toe-heel direction being made of a metal; the loft angle being 14 to 25°; the volume of the head being 100 to 220 cc; and the weight of the fiber reinforced resin portion being 6 to 20% of the weight of the golf club head.

The fiber reinforced resin portions of the golf club head disclosed in Japanese Patent Application Publication No. 2003-339920 and Japanese Patent Application Publication No. 2006-130065 are produced by molding a laminate of prepreg sheets. Because such an operation for laminating prepregs takes time and labor, costs of manufacture of the golf club head according to the above-described conventional techniques may become high.

SUMMARY OF THE INVENTION

A purpose of the present invention is to provide a hollow golf club head including a crown portion and back-side, toe-side, and heel-side side portions made of fiber reinforced thermosetting resins and of which the fiber reinforced resin portions can be readily manufactured.

Another purpose of the present invention is to provide a hollow golf club head of which main portions except a face portion are made of a fiber reinforced thermosetting resin and of which the fiber reinforced resin portions can be readily manufactured.

Yet another purpose of the present invention is to provide a hybrid type golf club head which allows a user to easily hit a ball at a high angle.

In order to achieve the above-described purposes, according to an aspect of the present invention, a hollow golf club head includes a face portion, a sole portion, a side portion, a crown portion, and a hozel portion, in which a main portion of the crown portion is made of a fiber reinforced resin; the fiber reinforced resin portion includes a bulk molding compound (BMC) molded body; and at least the face portion, a leading edge of the crown portion continuous with the face portion, and a center portion of the sole portion in a toe-heel direction are made of a metal.

An average length of fibers included in the BMC molded body may be 35 to 80 mm. The BMC molded body may include a thick portion which is partially thick.

According to the golf club head of the present aspect, because the fiber reinforced resin portion includes a BMC molded body, the fiber reinforced resin portion can be readily manufactured.

By using the fibers having an average length of 35 to 80 mm for the BMC molded body, a BMC molded body with a high strength can be achieved. In particular, even if the BMC molded body has a thick portion which is partially thick, a content of fiber of the thick portion is not different from those of the other portions. Accordingly, the strength of the thick portion is high.

According to another aspect of the present invention, a hollow golf club head includes a face portion, a sole portion, a side portion, a crown portion, and a hozel portion, in which the face portion is provided with a metal faceplate; a portion subsequent to the face portion includes a BMC molded body; and a rear portion of the crown portion includes a molded laminate of prepreg sheets.

An average length of the fibers included in the BMC molded body may be 35 to 80 mm. A protruding stripe is provided on a peripheral edge of a back surface of the face portion except in the hozel portion, and the protruding stripe can engage in grooves provided on a front surface of the BMC molded body.

According to the golf club head of the present aspect, because a main portion of the portion subsequent to the metal face portion includes a BMC molded body, the main portion of the portion subsequent to the metal face portion can be readily manufactured. In particular, according to the golf club head of the present aspect, because the rear portion of the crown portion includes a molded laminate of prepreg sheets, the crown portion can be easily deformed at the time of hitting a ball, and thereby a golf club head which allows a user to hit a ball at a high hitting angle can be achieved.

According to yet another aspect of the present invention, a hollow golf club head includes a face portion, a sole portion, a side portion, a crown portion, and a hozel portion, in which a front portion of the golf club head including the face portion is made of a metal; at least rear portions of the crown portion and the side portion are made of fiber reinforced synthetic resins; and a height of center of gravity of the golf club head is 24 mm or less.

A depth of center of gravity of the golf club head may be 36 mm or greater. A distance of center of gravity of the golf club head may be 35 to 46 mm. An angle of center of gravity of the golf club head may be 24 to 33°.

The face portion may be provided with a metal faceplate, the portion subsequent to the face portion may include a BMC molded body, and the rear portion of the crown portion may include a molded laminate of prepreg sheets. In addition, the entire fiber reinforced resin portion may include a BMC molded body. The average length of the fibers included in the BMC molded body may be 35 to 80 mm.

According to the golf club head of the present aspect, because the golf club head has a low center of gravity such that the height of the center of gravity is 24 mm or less, a user is allowed to easily hit a ball at a high angle. In other words, a golf club head which allows a user to hit a ball at a high hitting angle can be achieved.

With the depth of center of gravity of 36 mm or greater, a golf club head with a large sweet spot can be achieved. With the distance of center of gravity as large as 35 to 46 mm, a change in the face angle opening or closing during a swing of the golf club can be suppressed, and thereby the ball hitting direction becomes stable. With the angle of center of gravity as high as 24 to 33°, the face can be easily closed at the time of impact. Accordingly, slicing of a ball would not be easily caused.

DESCRIPTION OF THE EMBODIMENTS

Figure 1:
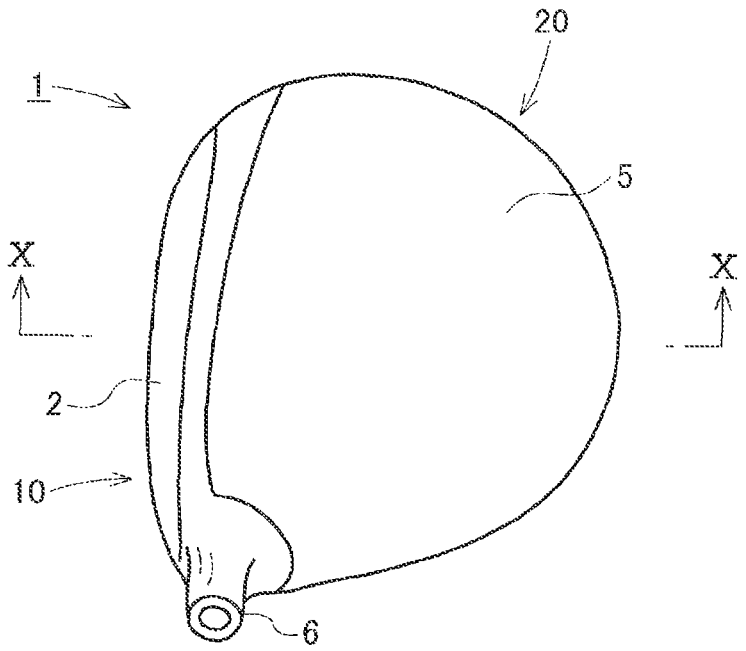
FIG. 1 is a plan view illustrating a first embodiment of a golf club head according to the present invention.
Figure 2:
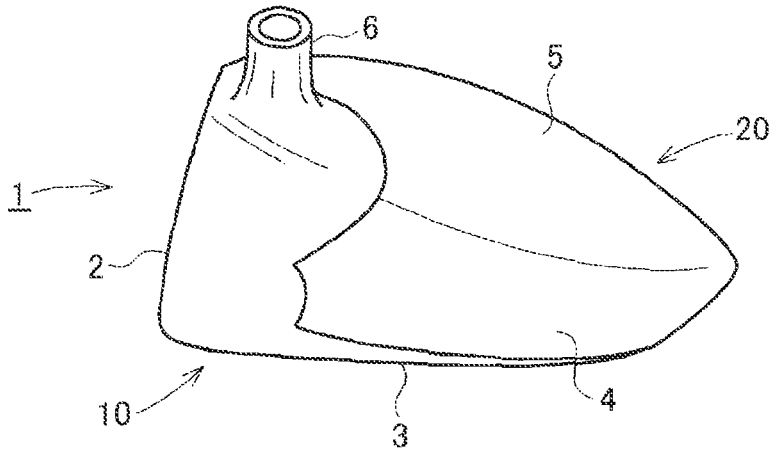
FIG. 2 is a side view of the golf club head illustrated in FIG. 1 viewed from a heel side thereof.
Figure 3:
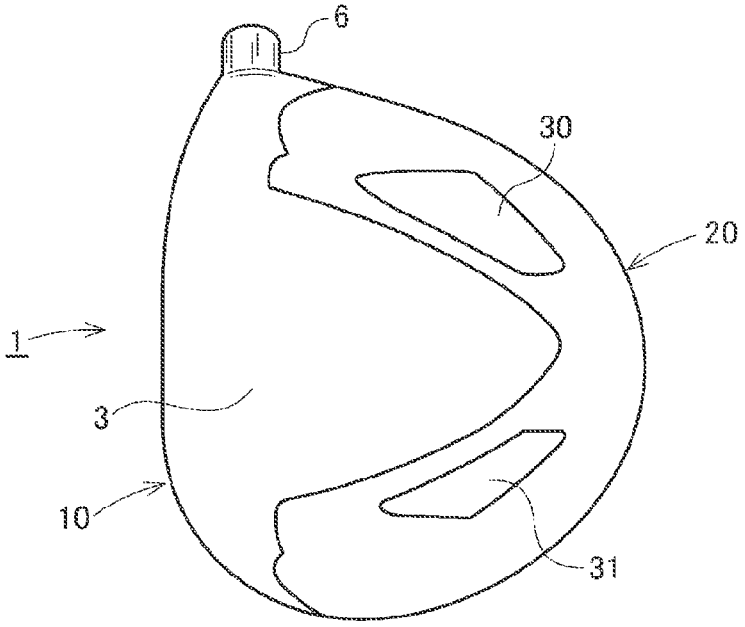
FIG. 3 is a bottom plan view of the golf club head illustrated in FIG. 1.
Figure 4:
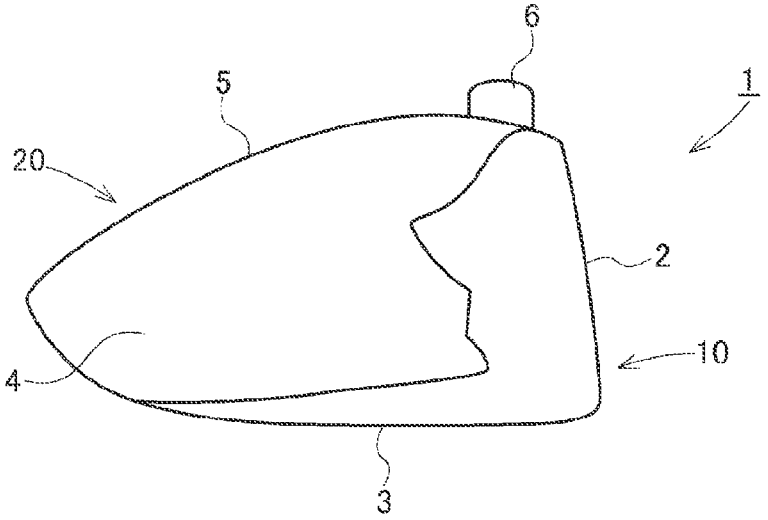
FIG. 4 is a side view of the golf club head illustrated in FIG. 1 viewed from a toe side thereof.

Hereinbelow, embodiments of a golf club head according to the present invention will be described in detail with reference to the attached drawings. However, the present invention is not limited to the following embodiments.

As shown in FIGS. 1 through 4, a golf club head according to a first embodiment is a hollow golf club head 1, which includes a face portion 2, a sole portion 3, a side portion 4, a crown portion 5, and a hozel portion 6.

The face portion 2 includes a surface for hitting a ball, on which grooves referred to as "score lines" (not shown) are provided. The sole portion 3 constitutes a bottom surface portion of the golf club head. The side portion 4 constitutes a side surface portion including a toe-side side surface, a heel-side side surface, and a back-side side surface. The crown portion 5 constitutes an upper surface portion of the golf club head. A shaft is inserted into the hozel portion 6 and is fixed to the hozel portion 6 with an adhesive.

The golf club head 1 includes a metal portion 10, which is constituted by a titanium alloy or the like, and a fiber reinforced resin portion 20, which includes a BMC molded body.

Figure 6:
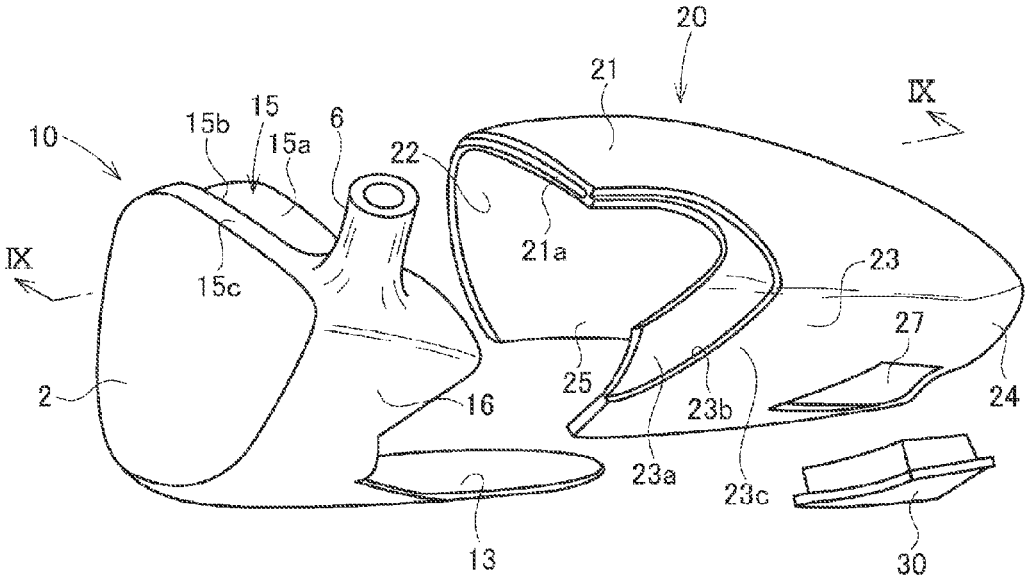
FIG. 6 is an exploded perspective view of the golf club head illustrated in FIG. 5.
Figure 7:
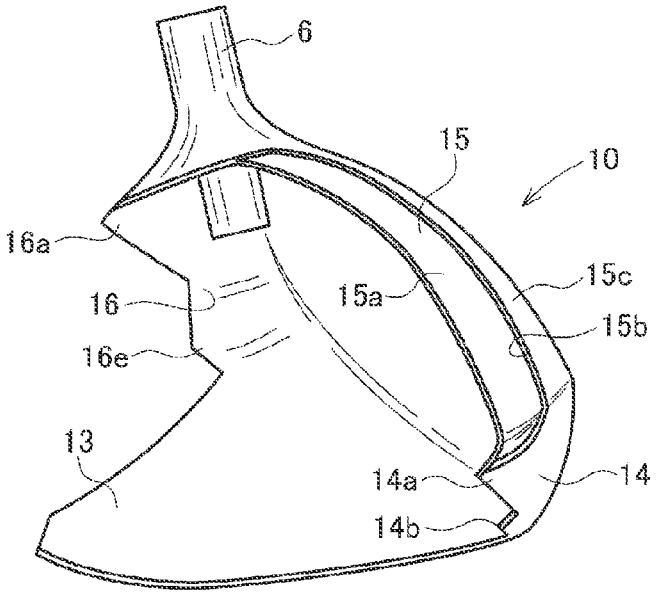
FIG. 7 is a perspective view of a metal portion of the golf club head illustrated in FIG. 6 viewed from the toe side thereof.

As shown in FIGS. 6 and 7, the metal portion 10 includes the face portion 2, a metal sole portion 13, a metal toe-side side portion 14, a metal crown portion 15, a metal heel-side side portion 16, and the hozel portion 6.

The metal crown portion 15, which constitutes a leading edge of the crown portion 5, is continuous with the metal toe-side side portion 14 and the metal heel-side side portion 16. The metal toe-side side portion 14 and the metal heel-side side portion 16 are respectively continuous with the metal sole portion 13. The metal crown portion 15, the metal side portions 14 and 16, and the metal sole portion 13 are continuous with the face portion 2.

The metal crown portion 15 includes a leading edge 15*c* and a thin portion 15*a*, which is located on a trailing edge side of the metal crown portion 15 and thinner than the leading edge 15*c*. A boundary between the thick leading edge 15*c* and the thin portion 15*a* includes a stepped surface 15*b*, which steps down from an upper surface of the metal crown portion 15.

In its front portion, the metal sole portion 13 has a total sole width extending from the toe side to the heel side of the golf club head. The metal sole portion 13 is formed to be gradually narrowed in width from front to rear. The rear portion of the metal sole portion 13 is located in the center portion of the golf club head in a toe-heel direction.

As shown in FIG. 7, the metal toe-side side portion 14 and the metal heel-side side portion 16 are provided with two protruding portions 14*a*, 14*b* and 16*a*, 16*b*, which extend toward the rear, respectively. Thus, the trailing edges of the metal side portions 14 and 16 extend back and forth in a meandering manner. Leading edges of the protruding portions 14*a*, 14*b* and 16*a*, 16*b* may be rounded.

It is preferable to integrally form the metal portion 10 by casting. However, the present invention is not limited to this. For example, the face portion 2 may include a faceplate formed by forging or press molding, the other portion of the metal portion 10 may be manufactured by casting (i.e., the cast product has an open face portion), and the faceplate may be engaged in the opening of the cast product to be fixed there by caulking, welding, or the like.

The face portion 2 is thick in its center portion and thin in its peripheral edge.

The fiber reinforced resin portion 20 constitutes the other portion of the metal portion 10 of an outer surface of the golf club head 1. In other words, the fiber reinforced resin portion 20 constitutes the substantially entire crown portion 5, a rear half portion of the side portion 4, and portions of the sole portion 3 except the metal sole portion 13.

The fiber reinforced resin portion 20 includes fiber reinforced synthetic plastics (FRP) produced by molding a BMC including reinforced fibers, such as carbon fibers having an average length of 35 to 80 mm, particularly preferably having an average length of 40 to 60 mm, with a mold. An average thickness of the fiber reinforced resin portion 20 is preferably 0.8 to 3.0 mm and is particularly preferably 1.0 to 1.5 mm. For the synthetic resin, epoxy resins and the like are preferable.

The fiber reinforced resin portion 20 includes an FRP crown portion 21, an FRP toe-side side portion 22, an FRP heel-side side portion 23, an FRP back-side side portion 24, and an FRP sole portion 25. The FRP sole portion 25 has a substantially U-like shape when viewed from a bottom surface thereof so that its shape matches a predetermined shape of the metal sole portion 13.

Figure 8:
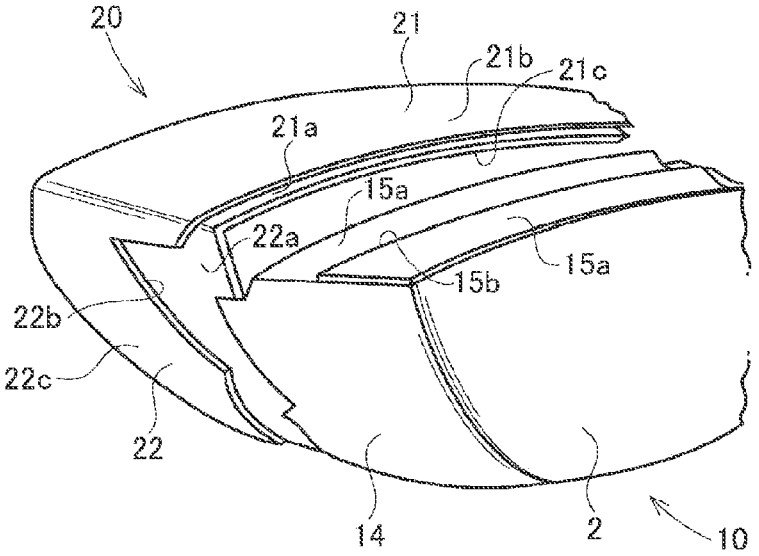
FIG. 8 is an enlarged exploded perspective view of a toe side portion of the golf club head illustrated in FIG. 5.

As shown in FIGS. 6 and 8, the FRP toe-side side portion 22 and the FRP heel-side side portion 23 include a leading edge-side thin portion 22*a*, 23*a* and a thick portion 22*c*, 23*c* located to the rear of the thin portion 22*a*, 23*a*, respectively. A boundary between the thin portion 22*a*, 23*a* and the thick portion 22*c*, 23*c* includes a stepped surface 22*b*, 23*b*, which steps down from an outer surface of the fiber reinforced resin portion 20. Each stepped surface 22*b*, 23*b* extends back and forth in a meandering manner. The meander shape of the stepped surface 22*b*, 23*b* matches the meander shape of the metal toe-side side portion 14 and the metal heel-side side portion 16, respectively.

Figure 9:
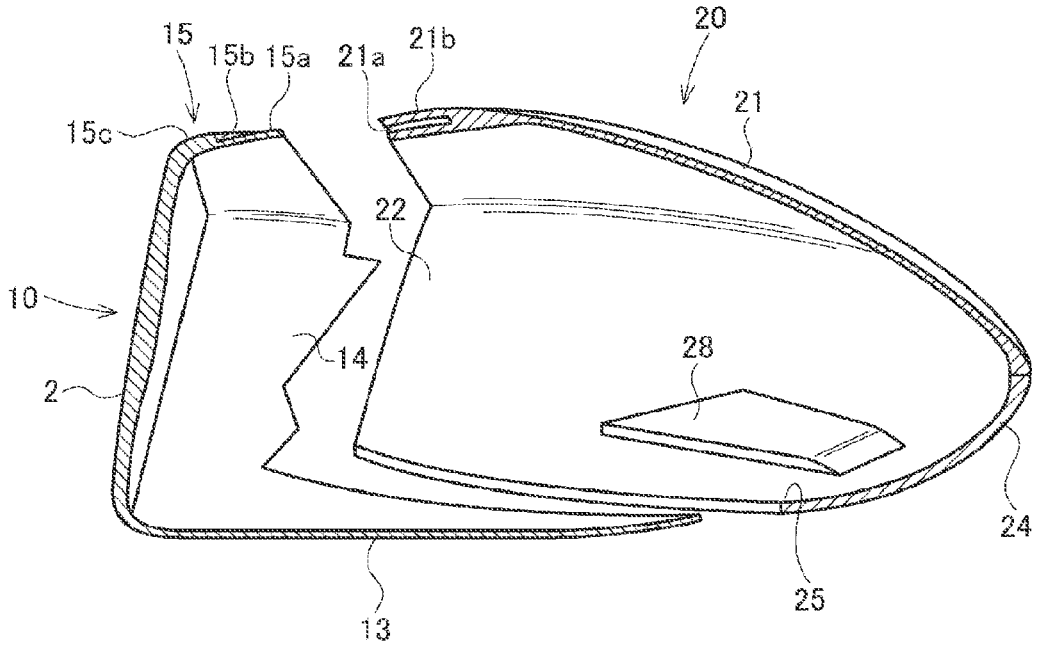
FIG. 9 is an exploded cross-sectional view showing the golf club head illustrated in FIG. 6 cut along a line IX-IX.
Figure 10:
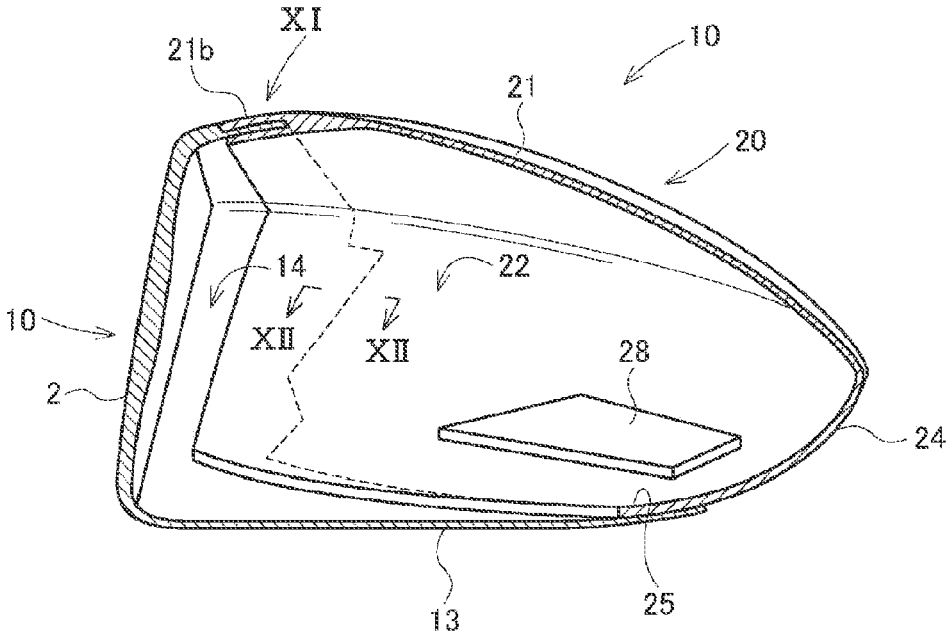
FIG. 10 is a cross section of the golf club head illustrated in FIG. 1 cut along a line X-X.

As shown in FIGS. 6, 9, and 10, the FRP crown portion 21 is provided with a slit-like groove 21*a*, which is formed on a leading edge of the FRP crown portion 21 as a recess from a front end surface thereof.

Figure 5:
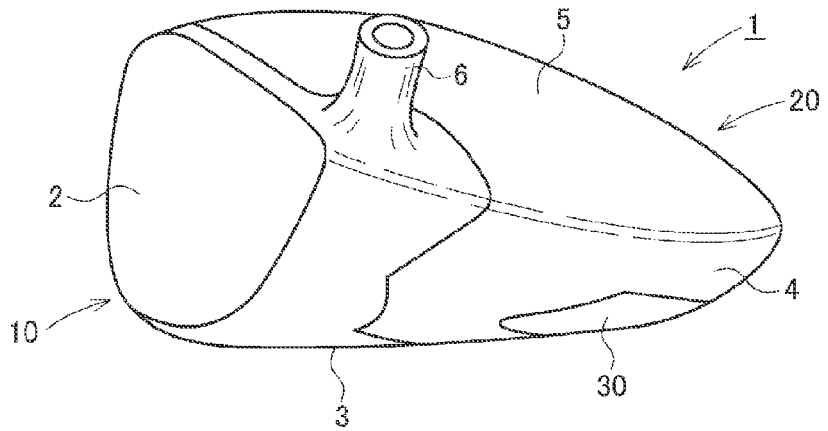
FIG. 5 is a perspective view of the golf club head illustrated in FIG. 1 viewed from the heel side thereof.

As shown in FIG. 6, a recess 27 is provided in a rear portion of the FRP heel-side side portion 23. Furthermore, a weight material 30 (FIGS. 3, 5, and 6) is bonded to the recess 27.

A shallow recess 28 (FIGS. 9 and 10) is provided in a rear portion of the FRP toe-side side portion 22. Moreover, a faceplate 31 (FIG. 3) is attached to the recess 28 with an adhesive, a double-sided adhesive tape, or the like. It is preferable that the shapes of the recesses 27 and 28 have a smooth slope towards a direction of removal of the mold as shown in FIG. 9, so that the mold can be easily removed.

The golf club head 1 can be manufactured by engaging the fiber reinforced resin portion 20 with the metal portion 10, then bonding them together with an adhesive, and then by performing finishing processes such as polishing, painting, and the like as necessary.

Figure 11:
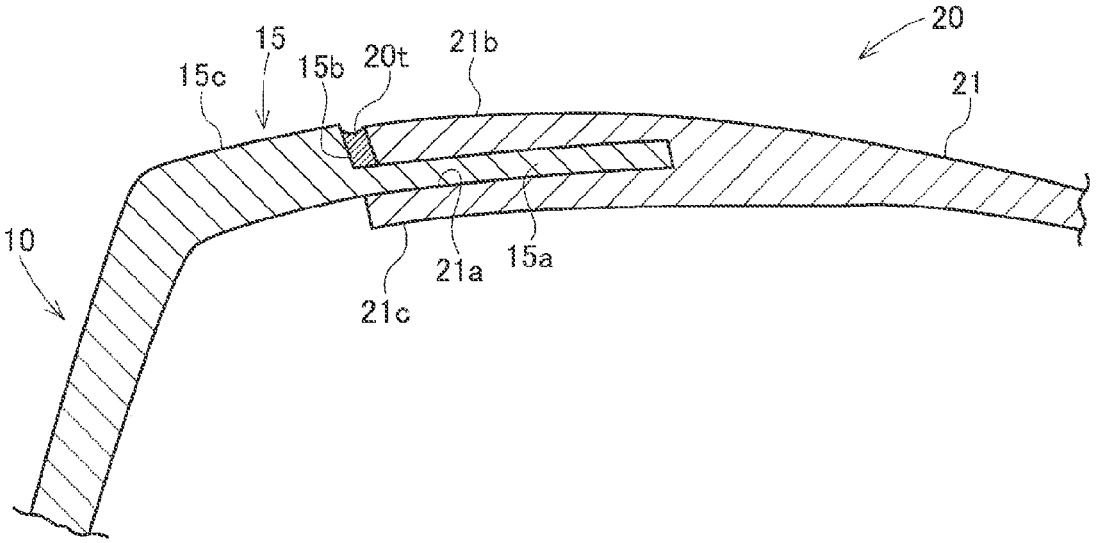
FIG. 11 is an enlarged cross section of a portion XI illustrated in FIG. 10.

In engaging the fiber reinforced resin portion 20 with the metal portion 10, at first, an adhesive is applied to both upper and lower surfaces of the thin portion 15*a* of the metal crown portion 15. Then the thin portion 15*a* of the metal crown portion 15 is inserted into the groove 21*a* of the fiber reinforced resin portion 20. Thus, an upper portion 21*b* and a lower portion 21*c* of the groove 21*a* can be bonded to the thin portion 15*a*. As shown in FIG. 11, a gap formed between a leading end of the upper portion 21*b* located above the groove 21*a* of the FRP crown portion 21 and the stepped surface 15*b* of the metal crown portion 15 can be filled with an adhesive or putty 20*t*. In FIG. 11, the upper surface of the adhesive or putty 20*t* is recessed from the upper surfaces of the metal crown portion 15 and the FRP crown portion 21. However, alternatively, these upper surfaces may be flush with one another.

Figure 12:
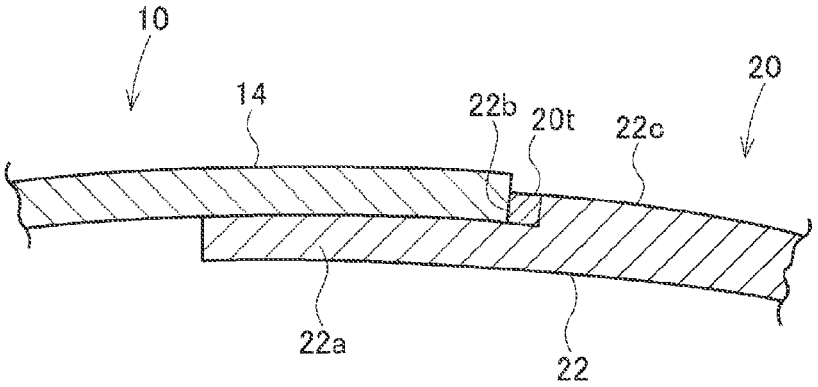
FIG. 12 is an enlarged cross section of the golf club head illustrated in FIG. 10 cut along a line XII-XII.
Figure 13:
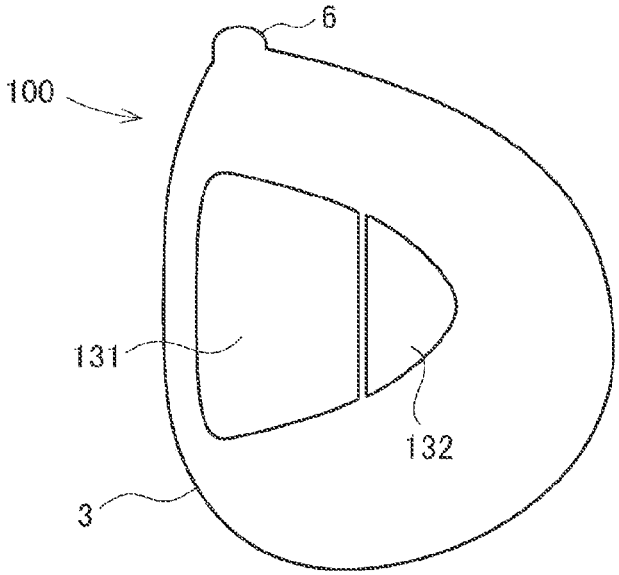
FIG. 13 is a bottom plan view of a second embodiment of the golf club head according to the present invention.
Figure 14:
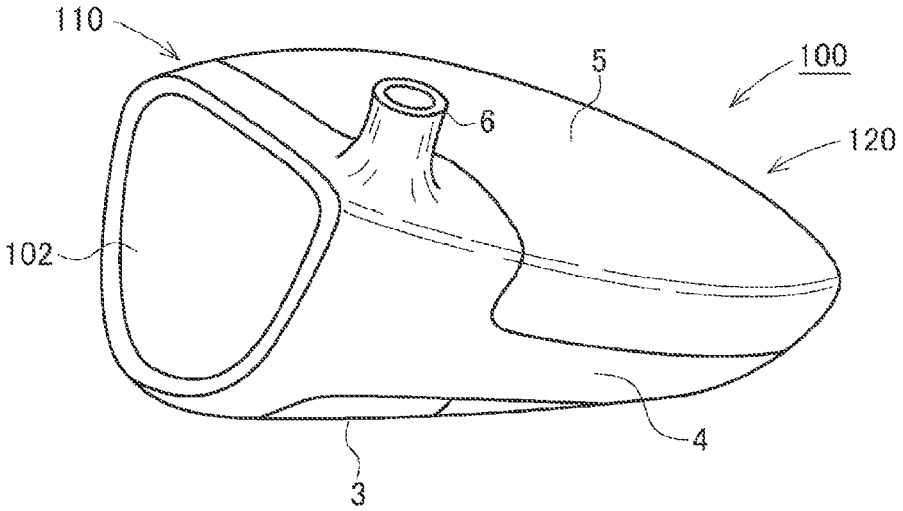
FIG. 14 is a perspective view illustrating the heel side of the golf club head according to the second embodiment.

With respect to the FRP side portions 22 and 23, the thin portions 22*a* and 23*a* thereof are superposed with and bonded to inner surfaces of the metal side portions 14 and 16. In this process, as shown in FIG. 12, a gap formed between the stepped surfaces 22*b* and 23*b* and the trailing edges of the metal side portions 14 and 16 is filled with the adhesive or putty 20*t*.

The FRP sole portion 25 is superposed with and bonded to the upper surface of the peripheral edge of the metal sole portion 13.

Because the fiber reinforced resin portion 20 of this golf club head 1 includes a BMC molded body, the fiber reinforced resin portion 20 can be easily molded. In addition, in molding a BMC, because a matrix resin and reinforced fibers integrally flow, segregation would not occur even if a BMC material flowed out from a thick portion molding cavity of the mold to its thin portion molding cavity. Accordingly, the contents of reinforced fiber of the thin portion and the thick portion would not be different from each other. Therefore, the strength of the thin portion can be maintained.

In the present embodiment, because the thin portion 15*a* of the metal crown portion 15 is inserted into the groove 21*a* provided on the leading edge of the FRP crown portion 21 of the fiber reinforced resin portion 20, the metal crown portion 15 and the FRP crown portion 21 are firmly bonded together. Even if the crown portion is deformed so as to be expanded upward at the time of hitting a ball, because the lower portion 21*c* is superposed with the thin portion 15*a* on the lower surface of the thin portion 15*a*, degradation of the bond strength between the metal crown portion 15 and the FRP crown portion 21 can be prevented.

In addition, in the present embodiment, in a joint portion between the fiber reinforced resin portion 20 and the metal portion 10 on the side of the sole, a terminal edge of the fiber reinforced resin portion 20 is slightly set back from the metal portion 10 towards the inside of the head as shown in FIG. 11. Accordingly, no peel force acts on the terminal edge of the fiber reinforced resin portion 20 when the joint portion is rubbed against other members, the ground, or the like. Therefore, the golf club head 1 with excellent durability can be achieved.

Note that in the present invention, the fiber reinforced resin portion 20 may include a crown portion and a sole portion manufactured separately and independently from each other and bonded together with an adhesive. To increase the strength of this adhesive bonding, it is preferable to slightly increase the thickness of abutting surfaces of the portions 10 and 20 as shown in FIG. 9.

Now, a second embodiment will be described in detail below with reference to FIGS. 13 through 18. Note that components similar to those of the first embodiment are provided with the same reference signs as those of the first embodiment. Accordingly, the detailed description thereof will not be repeated here.

A golf club head 100 of the present embodiment has a configuration similar to that of the first embodiment except the following configurations as shown in FIGS. 13 through 18. A face portion 102 of the golf club head 100 includes a faceplate 102P made of a metal such as titanium, except on its peripheral edge. In addition, a portion subsequent to the face portion 102 of the golf club head 100 includes a BMC portion 110, which includes a BMC molded body, and a unidirectional (UD) portion 120, which is produced by molding prepregs including reinforced fibers such as carbon fibers or the like and in which the reinforced fibers are oriented in one direction.

Figure 15:
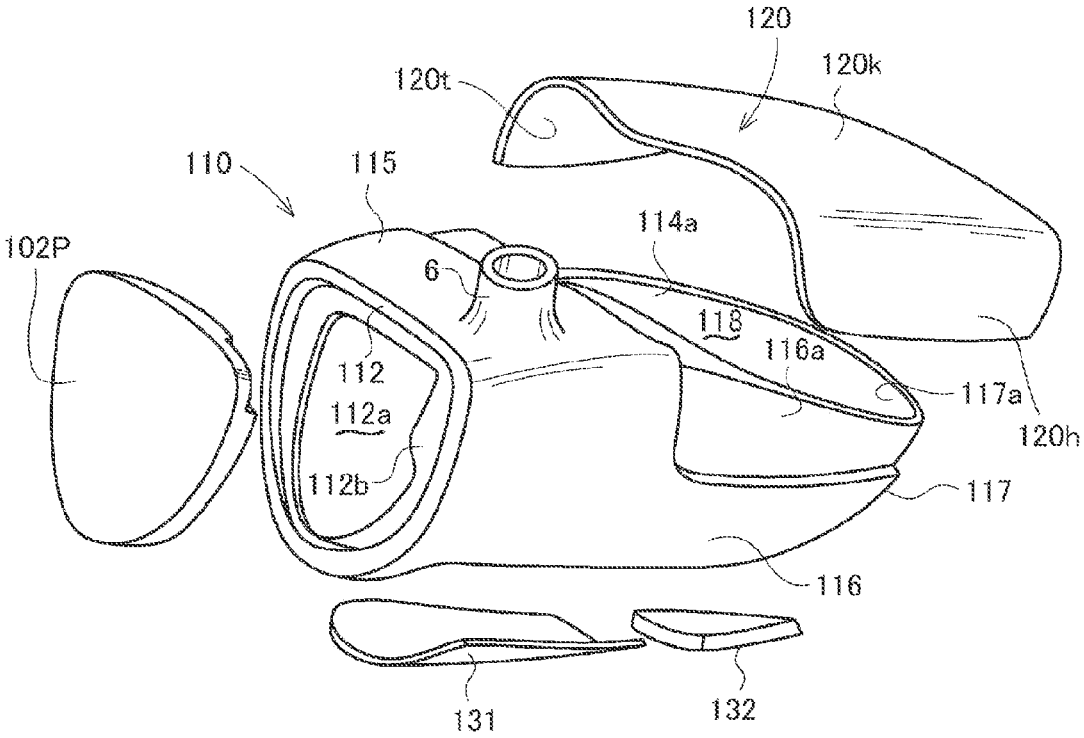
FIG. 15 is an exploded perspective view of the golf club head according to the second embodiment.
Figure 16:
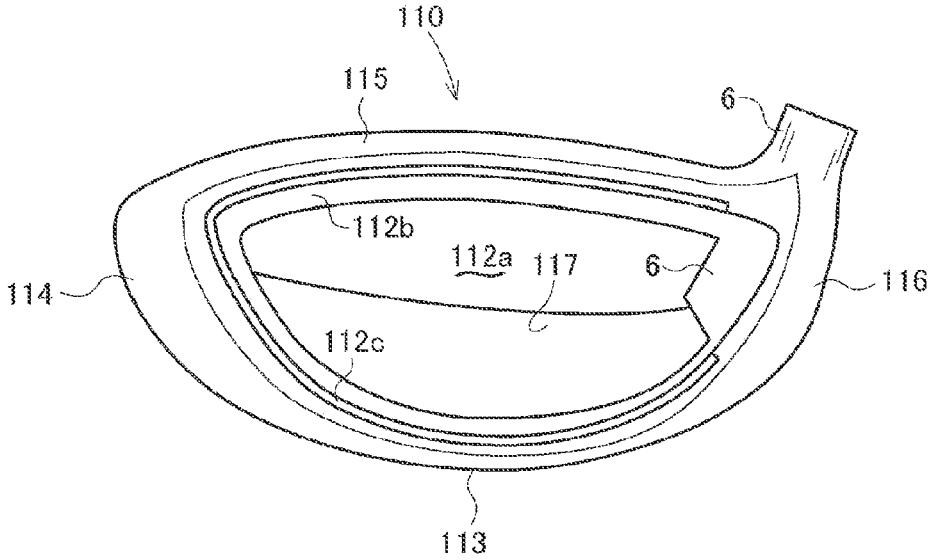
FIG. 16 is a front view illustrating a BMC portion of the golf club head illustrated in FIG. 15.

As shown in FIGS. 15 and 16, the BMC portion 110 includes a face frame portion 112, a BMC sole portion 113, a BMC toe-side side portion 114, a BMC crown portion 115, a BMC heel-side side portion 116, a BMC back-side side portion 117, and the hozel portion 6.

The face frame portion 112 has a shape of a frame surrounding the faceplate 102P. The face frame portion 112 is provided with an opening 112*a* formed in an inside thereof. A groove 112*c* is provided on a front surface side of an inner peripheral edge 112*b* of the face frame portion 112 at a location slightly separated from the inner peripheral edge. The groove 112*c* is formed over substantially the entire periphery of the opening 112*a* except in a portion in the vicinity of the hozel portion 6.

Figure 18:
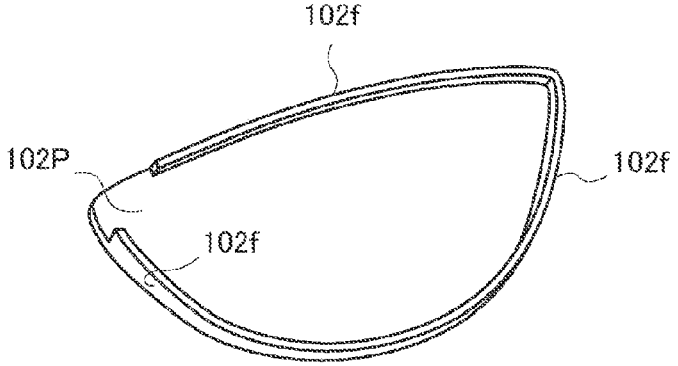
FIG. 18 is a perspective view of a faceplate viewed from the inside of the golf club head.

As shown in FIG. 18, a protruding stripe 102*f* is provided on a peripheral edge of the faceplate 102P on a back surface thereof except in a portion in the vicinity of the hozel portion 6. With the protruding stripe 102*f* being engaged with the groove 112*c*, the peripheral edge of the faceplate 102P is fixed to the edge 112*b* of the face frame portion 112 by bonding.

Figure 17:
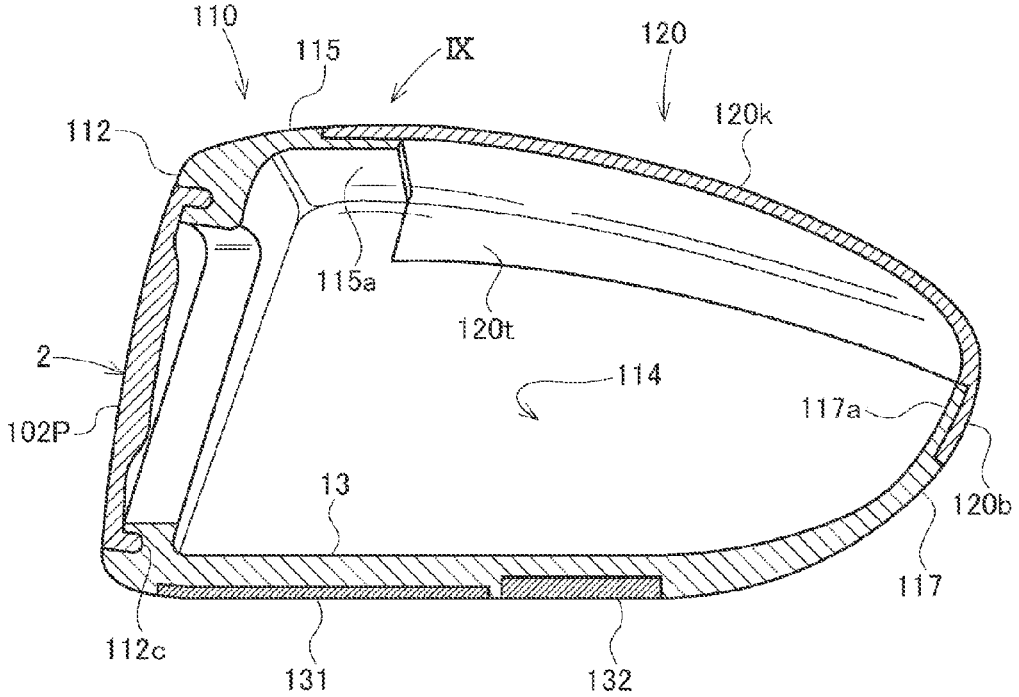
FIG. 17 is a cross section of the golf club head according to the second embodiment cut along a face-back direction.

As shown in FIG. 17, the faceplate 102P is configured so that the center portion thereof is thick and the peripheral edge thereof is thin.

The BMC toe-side side portion 114, the BMC heel-side side portion 116, and the BMC back-side side portion 117 are respectively continuous with the BMC sole portion 113. The BMC crown portion 115, the BMC side portions 114 and 116, and the BMC sole portion 113 are continuous with the face frame portion 112.

A shallow recess is formed respectively in the front portion and the rear portion of the BMC sole portion 113. A sole plate 131, which includes pure titanium or a titanium alloy, is provided to the BMC sole portion 113 in the front side recess thereof by bonding. The sole plate 131 is provided to prevent wear and tear of the sole portion 3 that may occur when the sole portion 3 is rubbed on a lawn or a training mat. A weight material 132, which includes tungsten, a tungsten alloy, stainless steel, or the like, is provided to the BMC sole portion 113 in the rear side recess thereof by bonding. The sole plate 131 and the weight material 132 are slightly separated from each other. More specifically, the BMC portion 110 is provided between them.

As shown in FIG. 15, upper edges of the BMC toe-side side portion 114, the BMC heel-side side portion 116, and the BMC back portion 117 constitute thin portions 114*a*, 116*a*, and 117*a*, respectively. A step portion which steps down from the outer surface is formed on a lower side portion of each of the thin portions 114*a*, 116*a*, and 117*a*.

The UD portion 120 includes an FRP crown portion 120*k*, an FRP toe-side side portion 120*t*, an FRP heel-side side portion 120*h*, and an FRP back-side side portion 120*b*. The UD portion 120 is a molded laminate produced by molding a plurality of laminated UD prepreg sheets including reinforced fibers, such as long carbon fibers, oriented in one direction and by applying pressure and heat thereto with a mold. In laminating the prepreg sheets, the prepreg sheets are laminated so that the reinforced fibers are oriented in an orthogonal direction or in an intersecting direction such as a direction slanting by 45°.

The golf club head 100 is manufactured by engaging the UD portion 120 with the BMC portion 110, then bonding them together with an adhesive, then bonding the faceplate 102P thereto, and then performing finishing processes such as polishing, painting, and the like as necessary. Note that the faceplate 102P may be previously bonded to the BMC portion 110.

In engaging the UD portion 120 with the BMC portion 110, an inner surface of a lower edge portion of the UD portion 120 is superposed with the thin portions 114*a*, 115*a*, 116*a*, and 117*a* of the BMC portion 110. A gap formed between the peripheral edge of the UD portion 120 and the step portion of the BMC portion 110 is filled with an adhesive or putty (not shown).

In the present embodiment, a rear portion of the crown portion 5 constitutes the UD portion 120, which is easily deformed at the time of hitting a ball. Accordingly, a golf club head which allows a user to hit a ball at a high hitting angle can be achieved.

In the golf club head 100, the hozel portion 6 and portions in the vicinity thereof are made of a BMC, and metal members are used for the faceplate 102P, the sole plate 131, and the weight material 132 only. The sole plate 131 of the sole portion is provided to prevent chafing and a thin plate having a thickness as thin as about 0.4 to 1.2 mm can be sufficiently used as the sole plate 131. With this configuration, a lightweight golf club head can be achieved. In addition, the ratio of the weight material 132 to the weight of the entire golf club head can be increased to increase the depth of center of gravity and decrease the height of center of gravity.

Figure 19:
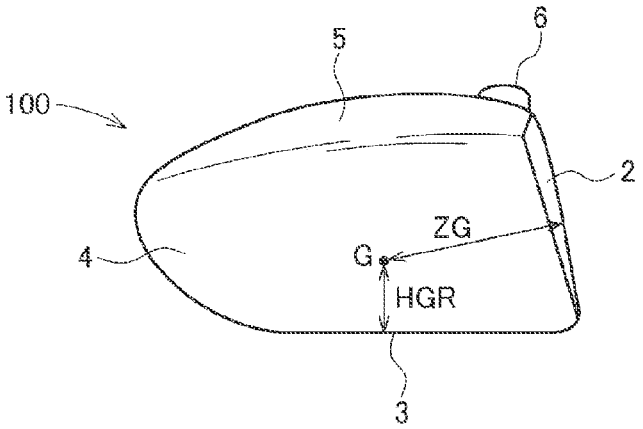
FIG. 19 is a view illustrating a height of center of gravity and a depth of center of gravity according to the third embodiment of the golf club head of the present invention.

Now, a third embodiment will be described in detail below with reference to FIGS. 19 through 21. Note that components similar to those of the second embodiment are provided with the same reference signs as those of the second embodiment. Accordingly, the detailed description thereof will not be repeated here.

The golf club head 100 of the present embodiment has a configuration similar to that of the second embodiment illustrated in FIGS. 13 through 18 and has the following configurations. The golf club head 100 is a driver head having a volume of 400 cc or greater, and more preferably a driver head having a volume of 400 to 460 cc.

In the present embodiment, a height of center of gravity (HG) is 24 mm or less, preferably 18 to 24 mm, and particularly preferably 19 to 22 mm. As shown in FIG. 19, the height of center of gravity (HG) is a height from a horizontal reference surface to the center of gravity measured in a state in which the golf club head 100 is soled to the horizontal reference surface.

When the height of center of gravity is lower than 24 mm, a user is allowed to easily hit a ball at a high angle.

In the present embodiment, a depth of center of gravity (ZG) is preferably 36 mm or greater and particularly preferably 38 to 45 mm. With the above-described great depth of center of gravity, a golf club head with a large sweet spot can be achieved. Accordingly, the possibility of a miss-shot is low even if a ball is hit at a point off the center of the sweet spot. As shown in FIG. 19, the depth of center of gravity refers to a length of a normal taken from the center of gravity to the surface of the face.

In the present embodiment, the distance of center of gravity (DG) is preferably 35 to 46 mm and particularly preferably 37 to 44 mm. With the above-described long distance of center of gravity, a motion of opening or closing the face angle occurring during a swing of the golf club is suppressed. Accordingly, the ball hitting direction becomes stable. As shown in FIG. 21, the distance of center of gravity refers to a distance from an axial line of the shaft (ALS) to the center of gravity (G).

In the present embodiment, the angle of center of gravity is preferably 22 to 33° and particularly preferably 24 to 31°. With the above-described high angle of center of gravity, the face can be easily closed at the time of impact. Accordingly, slicing of a ball would not be easily caused.

Figure 20:
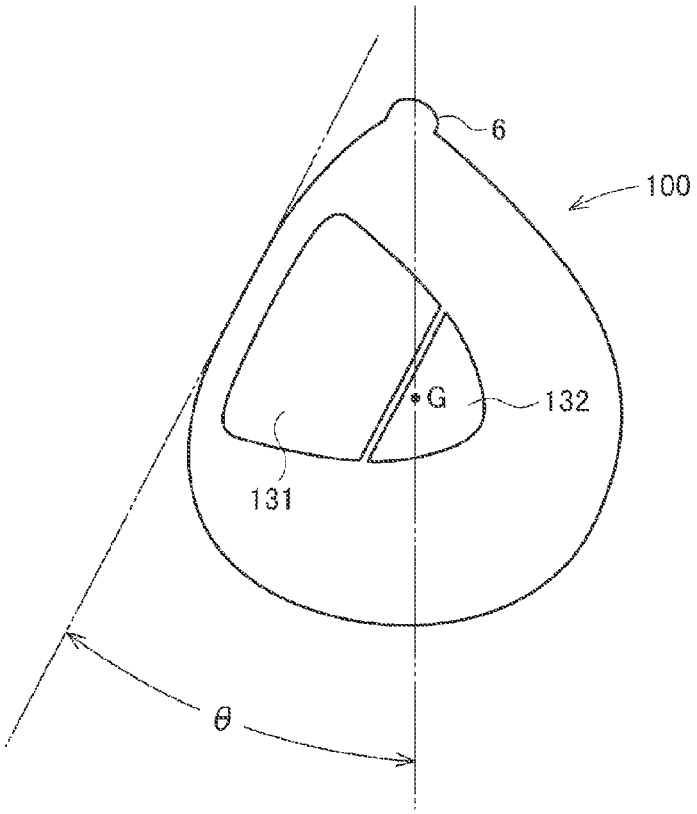
FIG. 20 is a view illustrating an angle of center of gravity according to the third embodiment of the golf club head of the present invention.
Figure 21:
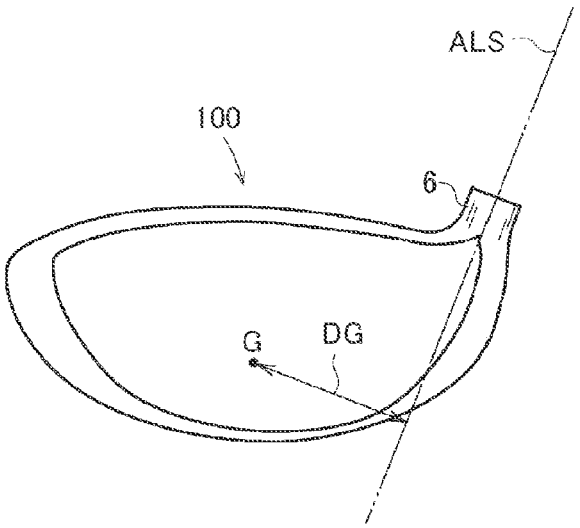
FIG. 21 is a view illustrating a distance of center of gravity according to the third embodiment of the golf club head of the present invention.

As shown in FIG. 20, the angle of center of gravity refers to an angle of intersection θ between a vertical plane including the axial line of the shaft and the surface of the face in a state in which the shaft is horizontally supported freely rotatably around the axial line of the shaft and the head is freely suspended from the shaft under the own weight of the head.

In the present embodiment, the height of center of gravity, the depth of center of gravity, the distance of center of gravity, and the angle of center of gravity can be variably changed by changing the location and the weight of the weight material 132.

In the present embodiment, heavy weight metal parts are used only for the faceplate and the weight material and all the other portions are made of fiber reinforced synthetic resins having a small weight. Accordingly, because the ratio of weight of the weight material 132 to the weight of the entire head is high as described above, the height of center of gravity, the depth of center of gravity, the distance of center of gravity, and the angle of center of gravity can be variably changed by changing the location of the weight material. In addition, the present embodiment can also be implemented with the configuration of the first embodiment.

EXAMPLES

Example 1

The following experiments on a golf club head according to the third embodiment were performed. In the golf club head, a weight material 132 including a tungsten-nickel alloy plate having an area of 630 $mm^2$, a thickness of 55 mm, and a weight of 60 g was produced. The surface center position of the weight material 132 was located on the sole center line (i.e., a line passing through the center in the toe-heel direction and extending in a direction normal to the leading edge of the face portion) and the distance from the surface center position of the weight material 132 to the surface of the face (the leading edge) was 58 mm.

A titanium alloy (Ti-6Al-4V alloy) faceplate having an area of 3,500 $mm^2$ and a weight of 40 g was produced. The volume of the head was 460 cc.

For the sole plate 131, a pure titanium sole plate having an area of 1,700 $mm^2$ and a weight of 7 g was produced. A height of center of gravity (HGR), the depth of center of gravity (ZG), the distance of center of gravity, and the angle of center of gravity of the golf club head were measured. Results of the measurement are shown in Table 1 and FIGS. 22 and 23.

Examples 2 to 5

Golf club heads were manufactured in a similar manner as example 1 except that weight materials having the weight and located at the location shown in Table 1 were produced. The height of center of gravity (HGR), the depth of center of gravity (ZG), the distance of center of gravity, and the angle of center of gravity of each of the golf club heads were measured. Results of the measurement are shown in Table 1 and FIGS. 22 and 23.

Comparative Examples 1 to 5

The height of center of gravity (HGR), the depth of center of gravity (ZG), the distance of center of gravity (DG), and the angle of center of gravity were measured for five types of commercial driver heads (the volume of each of the driver heads was 460 cc). Results of the measurement are shown in Table 1 and FIGS. 22 and 23.

Note that a head manufactured by A Corporation was used in comparative example 1. In the head used in comparative example 1, the front half (the face portion and the hozel portion) of the head was constituted by a titanium alloy and the rear half of the head was constituted by FRP. In each of comparative examples 2 to 5, a head manufactured by B Corporation constituted entirely by a titanium alloy was used. In comparative examples 3 and 5, the surface center position of the weight material was located closer to the heel side from the sole center line. In Table 1, a mark "-" represents an item that was not measured.

Figure 22:
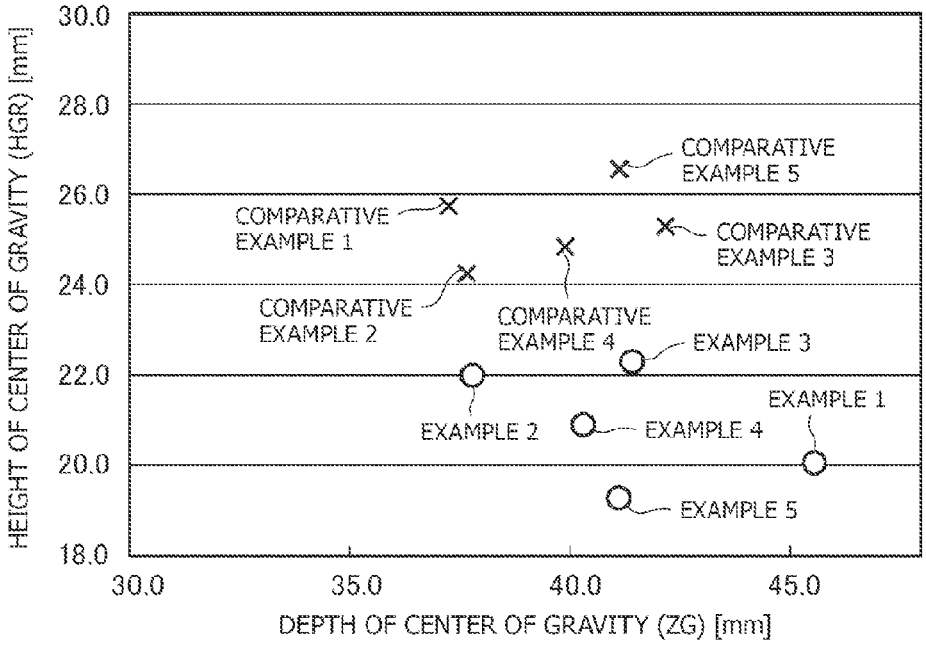
FIG. 22 is a graph showing results of examples and comparative examples.
Figure 23:
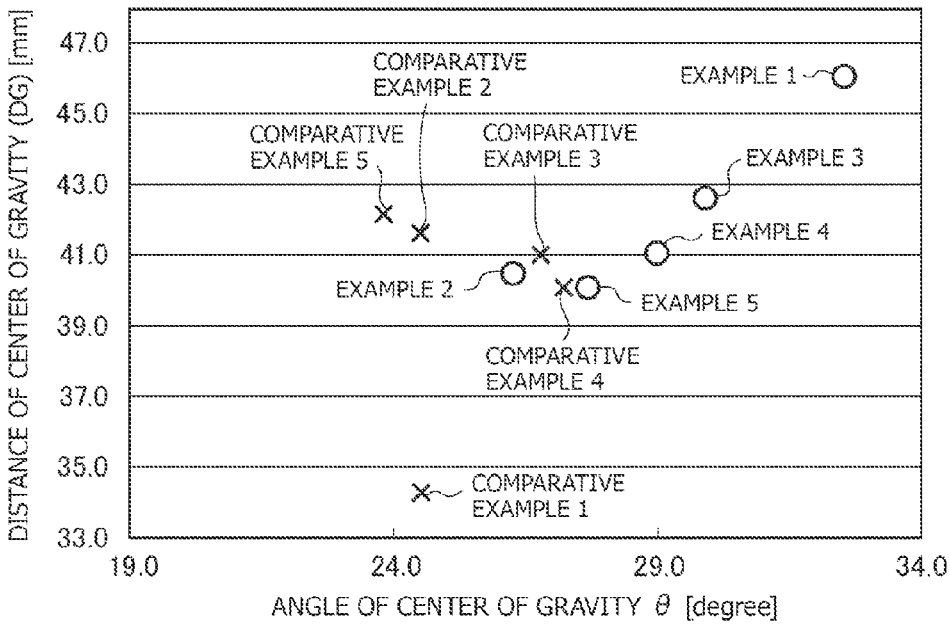
FIG. 23 is a graph showing results of examples and comparative examples.

As shown in Table 1 and FIG. 22, the heights of center of gravity for all the golf club heads according to the present invention were low. In addition, as shown in FIG. 23, the angles of center of gravity of most of the golf club heads according to the present invention were higher than those of the golf club heads used in comparative examples 1 to 5. In addition, as shown in FIGS. 22 and 23, the depths of center of gravity and the distances of center of gravity of most of the golf club heads according to the present invention were a little greater than those of the golf club heads used in comparative examples 1 to 5.

TABLE 1

| | Head weight (g) | Weight of weight material (g) | Surface center position of weight material: Distance from surface of the face (mm) | Surface center position of weight material: Distance from sole center line (mm) | Height of center of gravity HGR (mm) | Depth of center of gravity ZG (mm) | Distance of center of gravity DG (mm) | Angle of center of gravity θ (degrees) |
|---|---|---|---|---|---|---|---|---|
| Example 1 | 185 | 60 | 85 | 0 | 20.0 | 45.5 | 46.0 | 32.5 |
| Example 2 | 185 | 36 | 58 | 0 | 22.0 | 37.8 | 40.5 | 26.3 |
| Example 3 | 185 | 36 | 8 | 0 | 22.3 | 41.4 | 42.6 | 29.9 |
| Example 4 | 185 | 60 | 80 | 0 | 20.9 | 40.3 | 41.1 | 29.0 |

TABLE 1-continued

| | Head weight (g) | Weight of weight material (g) | Surface center position of weight material: Distance from surface of the face (mm) | Surface center position of weight material: Distance from sole center line (mm) | Height of center of gravity HGR (mm) | Depth of center of gravity ZG (mm) | Distance of center of gravity DG (mm) | Angle of center of gravity θ (degrees) |
|---|---|---|---|---|---|---|---|---|
| Example 5 | 185 | 48 | 58 | 0 | 19.3 | 41.1 | 40.1 | 27.7 |
| Comparative example 1 | 199 | — | — | — | 25.7 | 37.3 | 34.2 | 24.5 |
| Comparative example 2 | 184 | — | — | — | 24.3 | 37.7 | 41.7 | 24.5 |
| Comparative example 3 | 184 | — | 54 | 26 | 25.3 | 42.2 | 41.1 | 26.8 |
| Comparative example 4 | 184 | 10 | — | — | 24.8 | 39.9 | 40.1 | 27.2 |
| Comparative example 5 | 191 | 8 | 88 | 5 | 26.5 | 41.2 | 42.2 | 23.8 |

What is claimed is:

1. A hollow golf club head comprising a face portion, a sole portion, aside portion, a crown portion, and a hozel portion, wherein a main portion of the crown portion is made of a fiber reinforced resin and the fiber reinforced resin portion includes a bulk molding compound (BMC) molded body, wherein an average length of fibers included in the BMC molded body is 35 to 80 mm, and wherein at least the face portion, a leading edge of the crown portion continuous with the face portion, and a center portion of the sole portion in a toe-heel direction are made of a metal.

2. The golf club head according to claim 1, wherein the BMC molded body comprises a thick portion which is partially thick.

3. A hollow golf club head comprising a face portion, a sole portion, a side portion, a crown portion, and a hozel portion, wherein the face portion is provided with a metal faceplate, wherein a portion subsequent to the face portion comprises a BMC molded body, wherein an average length of fibers included in the BMC molded body is 35 to 80 mm. and wherein a rear portion of the crown portion comprises a molded laminate of prepreg sheets.

4. The golf club head according to claim 3, wherein a protruding stripe is provided on a peripheral edge of a back surface of the face portion except in the hozel portion and the protruding stripe is configured to engage in a groove provided on a front surface of the BMC molded body.

5. A hollow golf club head comprising a face portion, a sole portion, aside portion, a crown portion, and a hozel portion, wherein a front portion including the face portion is made of a metal, wherein at least rear portions of the crown portion and the side portion are made of a fiber reinforced synthetic resin, wherein the entire fiber reinforced resin portion includes a BMC molded body, the average length of the fibers included in the BMC molded body being 35 to 80 mm, and wherein a height of center of gravity of the golf club head is 24 mm or less, the height of center of gravity being a height from a horizontal reference surface to a center of gravity of the head measured in a state in which the head is soled to the horizontal reference surface.

6. The golf club head according to claim 5, wherein a depth of center of gravity of the golf club head is 36 mm or greater, the depth of center of gravity being a length of a normal taken from a center of gravity of the head to a surface of the face portion.

7. The golf club head according to claim 5, wherein a distance of center of gravity of the golf club head is 35 to 46 mm, the distance of center of gravity being a distance from an axial line of a shaft of the head to a center of gravity of the head.

8. The golf club head according to claim 5, wherein an angle of center of gravity of the golf club head is 24 to 33°, the angle of center of gravity being an angle of intersection between a vertical plane including an axial line of a shaft of the head and a surface of the face portion in a state in which the shaft is horizontally supported freely rotatably around the axial line of the shaft and the head is freely suspended from the shaft under the own weight of the head.

9. The golf club head according to claim 5, wherein the face portion is provided with a metal faceplate, wherein a portion subsequent to the face portion comprises a BMC molded body, and wherein a rear portion of the crown portion comprises a molded laminate of prepreg sheets.

* * * * *